US009447997B2

(12) United States Patent
Kyle et al.

(10) Patent No.: US 9,447,997 B2
(45) Date of Patent: Sep. 20, 2016

(54) CIRCULAR EVAPORATING COIL WITH BACKWARD INCLINED BLOWER WHEEL WITH A VERTICAL AXIS ROTATABLE DISCHARGE SHROUD

(71) Applicant: Pompanette, LLC, Charlestown, NH (US)

(72) Inventors: James H. Kyle, Alstead, NH (US); Henry E. Bandy, Port Saint Lucie, FL (US); David Allen Smith, Tampa, FL (US)

(73) Assignee: Pompanette, LLC, Charlestown, NH (US)

( * ) Notice: Subject to any disclaimer, the term of this patent is extended or adjusted under 35 U.S.C. 154(b) by 287 days.

(21) Appl. No.: 14/302,237

(22) Filed: Jun. 11, 2014

(65) Prior Publication Data

US 2014/0360221 A1 Dec. 11, 2014

Related U.S. Application Data

(60) Provisional application No. 61/833,601, filed on Jun. 11, 2013.

(51) Int. Cl.

| | |
|---|---|
| ***F25D 17/06*** | (2006.01) |
| ***F25B 39/02*** | (2006.01) |
| ***B63J 2/04*** | (2006.01) |
| ***F24F 1/00*** | (2011.01) |
| ***F25B 1/00*** | (2006.01) |

(52) U.S. Cl.

CPC ..... *F25B 39/02* (2013.01); *B63J 2/04* (2013.01); *F24F 1/0003* (2013.01); *F25B 1/005* (2013.01); *F25B 2400/071* (2013.01); *F25B 2500/01* (2013.01)

(58) Field of Classification Search

CPC .. F25B 41/062; F25B 49/0022; F25B 39/02; F24F 13/20; F24F 5/0017

USPC ..... 62/115, 119, 454, 498, 515, 519

See application file for complete search history.

(56) References Cited

U.S. PATENT DOCUMENTS

| | | | | |
|---|---|---|---|---|
| 2,044,832 A | | 6/1936 | Child | |
| 2,048,246 A | | 7/1936 | Dasher | |
| 2,182,569 A | * | 12/1939 | Peo | B60H 1/3229 62/241 |
| 2,911,797 A | | 11/1959 | Stocking | |

(Continued)

FOREIGN PATENT DOCUMENTS

| | | |
|---|---|---|
| JP | 405093524 | 4/1993 |
| JP | 405264066 | 10/1993 |

*Primary Examiner* — Melvin Jones

(74) *Attorney, Agent, or Firm* — Simpson & Simpson, PLLC

(57) ABSTRACT

An air conditioning unit including a condenser, a compressor, an evaporator system having an evaporator coil and a plurality of evaporator fins in contact with the evaporator coil, wherein the evaporator system forms a generally hollow cylindrical shape, a blower having an intake side and an exhaust side, the blower adapted to draw a volume of air through the plurality of evaporator fins and expel the volume of air in a direction generally perpendicular with a longitudinal axis of the evaporator system, and an exhaust shroud arranged adjacent the exhaust side of the blower, wherein the exhaust shroud is adapted for rotational movement about the longitudinal axis of the evaporator system, the compressor is arranged in fluid communication with the evaporator system and the condenser, and the evaporator is arranged in fluid communication with the condenser.

11 Claims, 12 Drawing Sheets

(56) References Cited

U.S. PATENT DOCUMENTS

| | | | | |
|---|---|---|---|---|
| 2,995,906 | A * | 8/1961 | Brandimarte | F25D 17/067 165/124 |
| 3,159,984 | A * | 12/1964 | Eberhart | F24F 13/224 62/279 |
| 5,848,536 | A | 12/1998 | Dodge et al. | |
| 6,357,249 | B1 | 3/2002 | Robinson et al. | |
| 7,367,380 | B2 | 5/2008 | Lee et al. | |
| 7,908,879 | B1 | 3/2011 | Chen | |
| 2010/0251739 | A1 | 10/2010 | Mabru | |

* cited by examiner

CIRCULAR EVAPORATING COIL WITH BACKWARD INCLINED BLOWER WHEEL WITH A VERTICAL AXIS ROTATABLE DISCHARGE SHROUD

CROSS-REFERENCE TO RELATED APPLICATIONS

This application claims the benefit under 35 U.S.C. §119 (e) of U.S. Provisional Patent Application No. 61/833,601, filed Jun. 11, 2013, which application is incorporated herein by reference in its entirety.

FIELD OF THE INVENTION

The invention broadly relates to air handlers used in split air conditioning (AC) systems, more specifically to marine air conditioning systems, and even more particularly to a marine self-contained air conditioning system using a circular evaporating coil with a backward inclined blower wheel having a vertical axis rotatable discharge shroud.

BACKGROUND OF THE INVENTION

Smaller yachts of the size 30 to 50 feet use what is known as a self-contained air conditioning system to cool the interiors of the yachts. In the simplest description this unit comprises a compressor, tube in tube condensing coil that uses water as the cooling medium, an evaporator coil, and a fan, typical of any self-contained AC unit that uses a tube in tube condenser. All of these components are mounted on one base pan. Yachts recirculate the air inside the cabins and only use a closed system of cooling. Depending on the size of the yacht, several units might be used to meet the cooling needs of the boat's interior. These self-contained air conditioning systems were introduced to the boating public around 1960 and have remained fundamentally unchanged in design and concept since that time. Dometic's Marine Air and Cruise Air divisions were the original developers of the concept.

On larger yachts where there is more room in the interiors, it is typical to use a split system air conditioning system. With this system the compressor and condensing coil are mounted in the engine room and air handlers consisting of the evaporator coil and fan are remotely mounted. Lines of compressed Freon gas connect the two assemblies. In addition chilled water systems can also be used on the larger yachts, where chilled water is produced in the engine room and pumped to air handlers that use finned coils and fans with the water as the cooling medium.

There are multiple challenges faced for cooling smaller boats. The size of the unit is an issue as it is typically mounted under a bunk top or sofa (settee). As bunks and built-in seating are about 18 inches off the floor and cushions are typically 4 inches thick, the structure of the seat leaves about 12-13 inches in height within which to work. Typically, 16,000 BTU compressors are about 12 inches in height. Thus, the largest self-contained systems are typically limited to 16,000 BTU in capacity. In addition to the height constraints, the width of the units is also constrained by the usual curvature of the hull outboard of the seats or bunks, both fore and aft and vertically. Packaging and overall configuration are critical and dictated by the interior layouts of a typical yacht.

As mentioned, the air conditioning systems are closed loops, recirculating the cabin air. For the air to reach the self-contained unit, it must pass through a grill in the front of the interior cabinetry and then pass through the evaporating coil and blower to be forced down ducting to be discharged at the appropriate locations in the interior of the yacht to provide uniform cooling. The vertical compressor and large fan of the self-contained unit makes it noisy and contributes to vibration. Yachts are usually made of fiberglass and plywood which are easily set into motion as these materials are flat and have a low modulus of elasticity (flexible). In addition, sound comes out through the grills mounted in front of the unit directly into the living space. It is desirable to keep sound levels and vibration levels to the lowest possible limits.

There is a lot of expensive copper and copper nickel used in the construction of the air conditioning units. Any increase in thermal efficiency results in a more efficient unit, i.e., more BTU's produced, packaged in the same size envelope, or if the same output was desired the components could be downsized and hence the cost and size of the components. In addition, there is limited power available on the docks of the marinas. If increased efficiency was possible, less power would be consumed to produce the same cooling capacity. Both cost and power consumption are very important in the industry.

As can be seen in FIGS. 1-5, the current standard configuration of air conditioner 20 includes evaporator coil 22 having a rectangular shape. On the other side of coil 22 is centrifugal blower 24 with motor 26 mounted outside of fan wheel 28. Incoming air 30 travels through coil 22, enters close coupled fan 24 and exits forward or aft in the vessel (not shown). In most designs, housing 32 of blower 24 can be rotated around a horizontal axis as depicted by bi-directional arrow 34 so output 36 of fan 24 points in the desired direction (See the difference in the position of housing 32 and output 36 as depicted in FIGS. 3 and 4). It should be noted that the airflow over evaporator coils 22 (depicted as uni-directional arrows 38) is not uniform as can be readily seen in FIG. 5. Corners 40 of evaporator coils 22 experience little airflow in those regions as there is no provision made for air to flow in those areas. In short, the abrupt changes in direction of coupling 42 and non-aerodynamically arranged shapes thereof preclude reasonable air flow in those regions. In the scenario described above the ducting can only run fore and aft as the bunk top is directly above the unit, and since the total foot print of self-contained unit 20 is rectangular in nature, unit 20 has to be configured and mounted such that the long side is always parallel to the interior joinery.

Another configuration of an evaporator coil and fan was recently developed by Marvair, i.e., the Marvair Self-Contained Model 24. The coil is still the same rectangular coil as described above, but an inline blower is close mounted to the center of the coil and this fan discharges into a rectangular shroud that surrounds the fan and that is attached to the perimeter of the coil. This arrangement pressurizes the shroud which allows for holes in the shroud to be opened so that air can escape from the top or either side of the shroud. This eliminates the need to rotate a centrifugal blower discharge. This and the foregoing geometry utilize large rectangular coils through which flowing air must then enter into a small round inlet, e.g., coupling 42, to a blower, which is then abruptly diverted 90 degrees and exits through a hole not in line with the air flow exiting the fan. It is believed that this arrangement is very inefficient.

As can be derived from the variety of devices and methods directed to moving air through a set of evaporator coils and exiting a fan mounted in line with the coils, in particular a self-contained marine air conditioner incorporating these components, many means have been contemplated to accomplish the desired end, i.e., a cost effective, compact assembly that fits in the required space while permitting a variety of air flow directions. Heretofore, tradeoffs between cost, and performance were required. Thus, there is a long-felt need for a high efficiency self-contained marine air conditioning unit whose design can be used in split and chilled systems that are also used in the marine industry as well as other industries.

BRIEF SUMMARY OF THE INVENTION

The present invention broadly comprises a marine self-contained air conditioning system using a circular evaporating coil with backward inclined blower wheel having a vertical axis rotatable discharge shroud.

Broadly, the present invention comprises an air conditioning unit including a condenser, a compressor, an evaporator system, a blower and an exhaust shroud. The evaporator system includes an evaporator coil and a plurality of evaporator fins in contact with the evaporator coil, wherein the evaporator system forms a generally hollow cylindrical shape. The blower includes an intake side and an exhaust side, where the blower is adapted to draw a volume of air through the plurality of evaporator fins and expel the volume of air in a direction generally perpendicular with a longitudinal axis of the evaporator system. The exhaust shroud is arranged adjacent the exhaust side of the blower, the exhaust shroud is adapted for rotational movement about the longitudinal axis of the evaporator system, the compressor is arranged in fluid communication with the evaporator system and the condenser, and the evaporator is arranged in fluid communication with the condenser.

In some embodiments, the evaporator coil forms the generally hollow cylindrical shape. In some embodiments, the plurality of evaporator fins forms the generally hollow cylindrical shape.

In some embodiments, the air conditioning unit further includes a duct, the evaporator system includes a first end and a second end opposite the first end, the duct is arranged at the second end between the evaporator system and the blower, and the blower draws the volume of air through the plurality of evaporator fins, through the duct and expels the volume of air into the exhaust shroud. In some embodiments, the air conditioning unit further includes a shaped base unit arranged at the first end opposite the blower, and the shaped base unit directs the volume of air towards the duct. In some embodiments, the air conditioning unit further includes a retaining ring and the exhaust shroud includes a circumferential flange, wherein the duct is arranged adjacent the second end, the circumferential flange is arranged adjacent the duct and the retaining ring is arranged adjacent the circumferential flange, whereby the exhaust shroud is rotatable about the longitudinal axis.

In some embodiments, the air conditioning unit further includes a shaped base unit, wherein the evaporator system comprises a first end and a second end opposite the first end, the shaped base unit is arranged at the first end opposite the blower, and the shaped base unit directs the volume of air towards the blower. In some embodiments, the air conditioning unit further includes a retaining ring and the exhaust shroud includes a circumferential flange, wherein the evaporator system includes a first end and a second end opposite the first end, the circumferential flange is arranged adjacent the second end and the retaining ring is arranged adjacent the circumferential flange, whereby the exhaust shroud is rotatable about the longitudinal axis. In some embodiments, the exhaust shroud is adapted to rotate approximately two hundred seventy degrees about the longitudinal axis.

Broadly, the present invention also comprises an air conditioning unit including a condenser, a compressor, an evaporator system, a blower, an exhaust shroud and a mounting pan. The evaporator system includes an evaporator coil and a plurality of evaporator fins in contact with the evaporator coil, wherein the evaporator system forms a generally hollow cylindrical shape. The blower includes an intake side and an exhaust side, where the blower is adapted to draw a volume of air through the plurality of evaporator fins and expel the volume of air in a direction generally perpendicular with a longitudinal axis of the evaporator system. The exhaust shroud is arranged adjacent the exhaust side of the blower, the exhaust shroud is adapted for rotational movement about the longitudinal axis of the evaporator system, the compressor is arranged in fluid communication with the evaporator system and the condenser, and the evaporator is arranged in fluid communication with the condenser. The compressor and the evaporator system are secured to the mounting pan.

Broadly, the present invention also comprises an air conditioning unit including an evaporator system, a blower and an exhaust shroud. The evaporator system includes an evaporator coil and a plurality of evaporator fins in contact with the evaporator coil, wherein the evaporator system forms a generally hollow cylindrical shape. The blower includes an intake side and an exhaust side, the blower is adapted to draw a volume of air through the plurality of evaporator fins and expel the volume of air in a direction generally perpendicular with a longitudinal axis of the evaporator system. The exhaust shroud is arranged adjacent the exhaust side of the blower, wherein the exhaust shroud is adapted for rotational movement about the longitudinal axis of the evaporator system.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
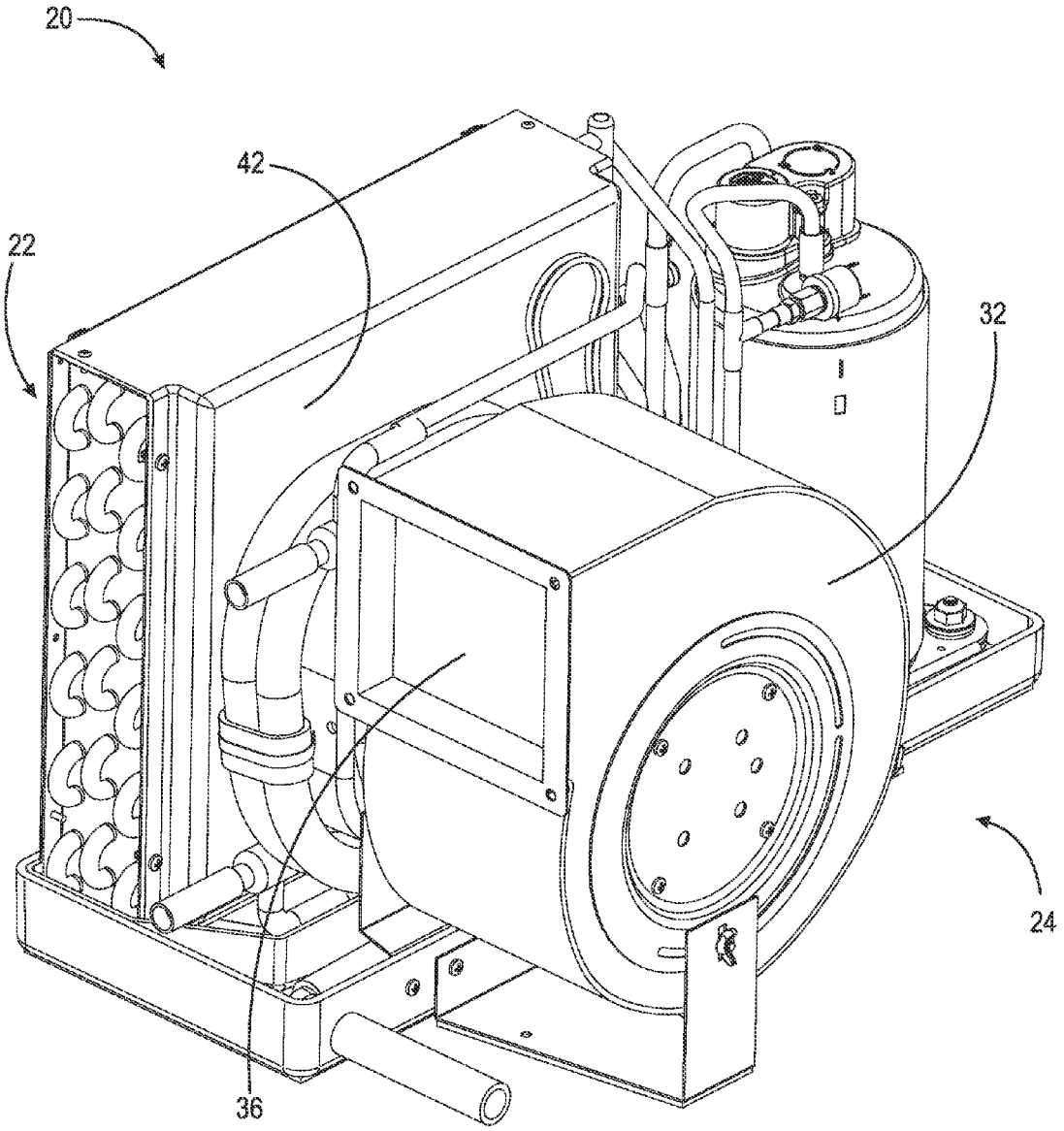
PRIOR ART Fig. 1
FIG. 1 is a first perspective view of a prior art air conditioning system.
Figure 2:
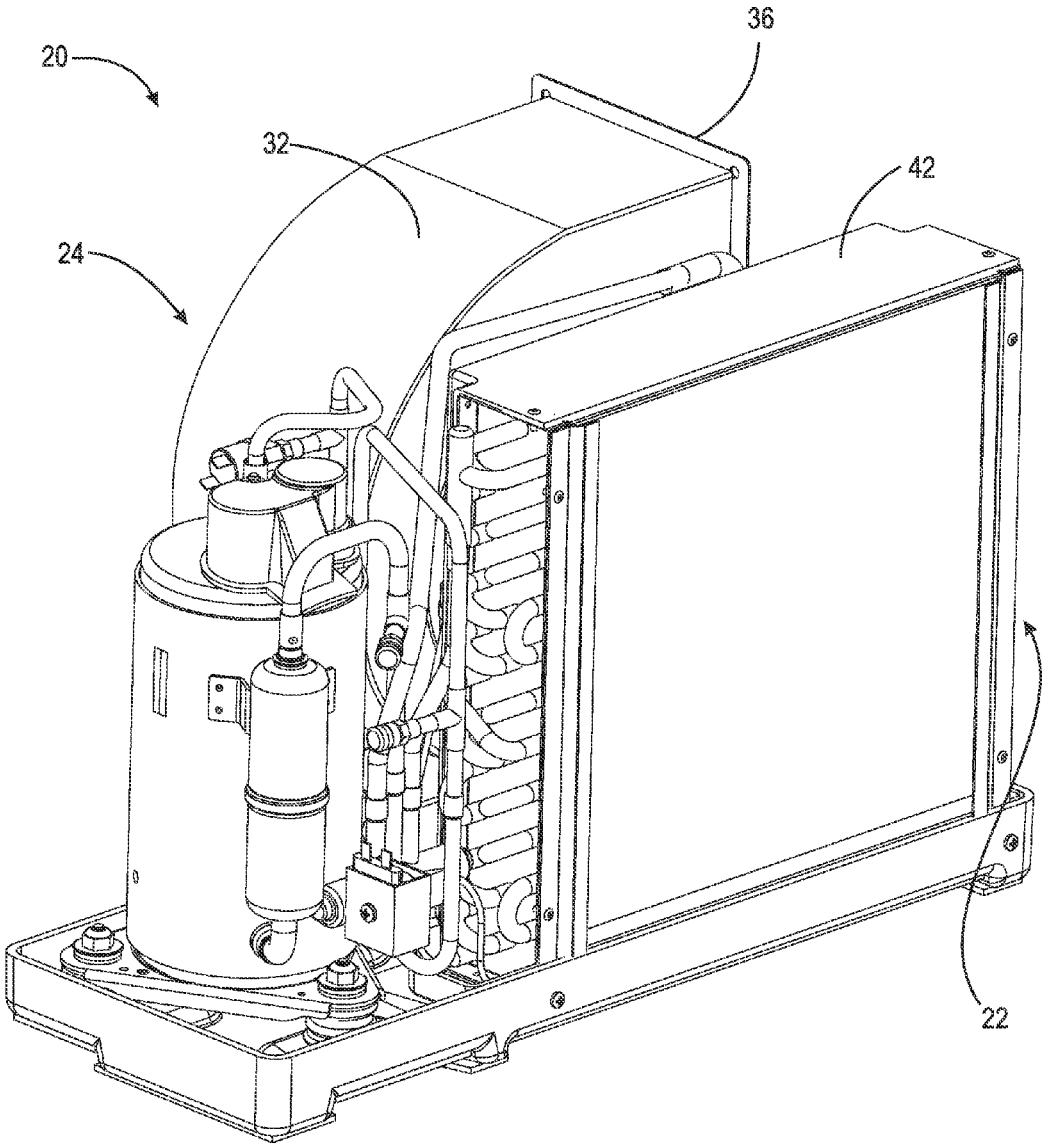
PRIOR ART Fig. 2
FIG. 2 is a second perspective view of the prior art air conditioning system of FIG. 1.
Figure 3:
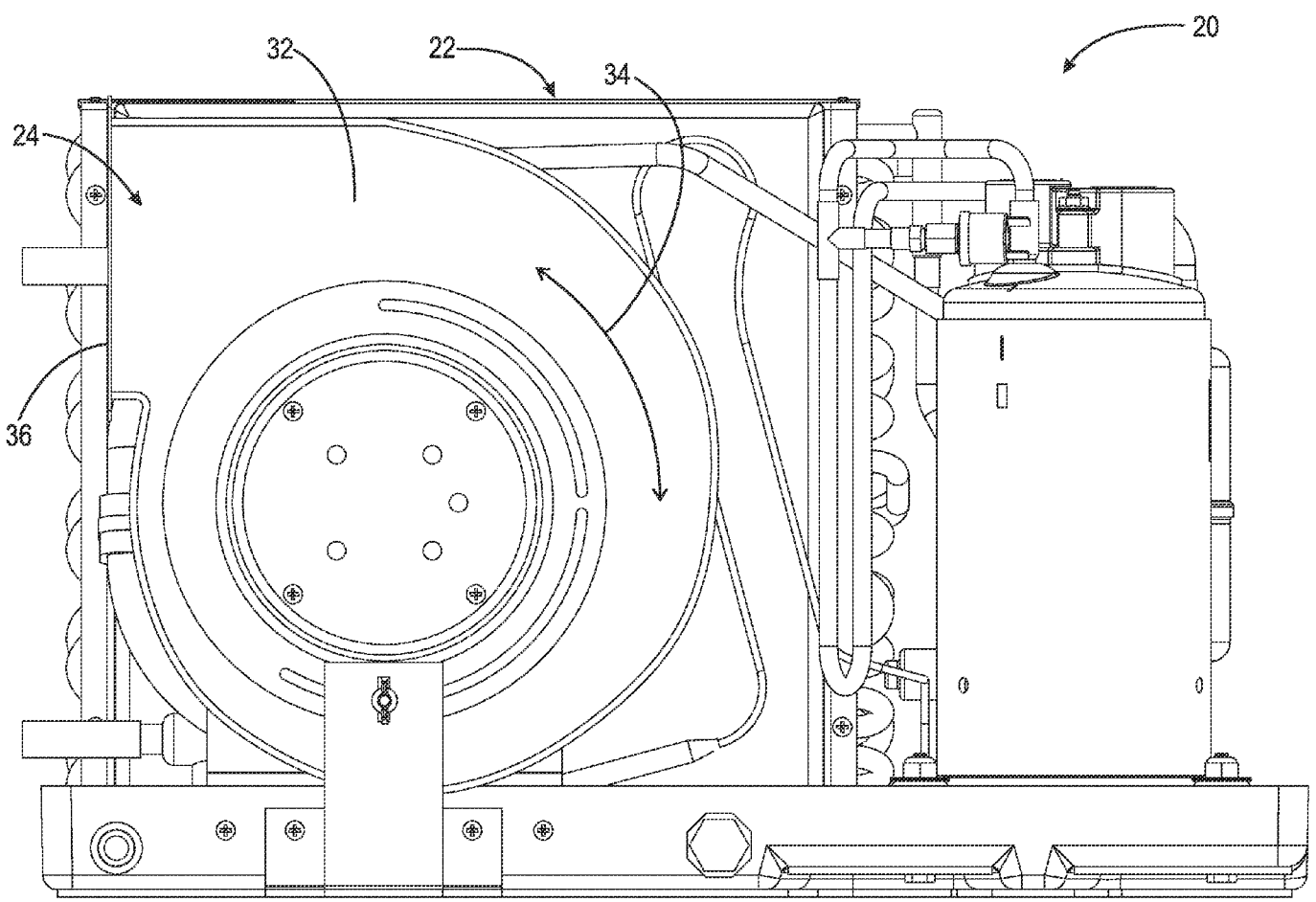
PRIOR ART Fig. 3
FIG. 3 is a side elevational view of the prior art air conditioning system of FIG. 1 with the air guide in a first position.
Figure 4:
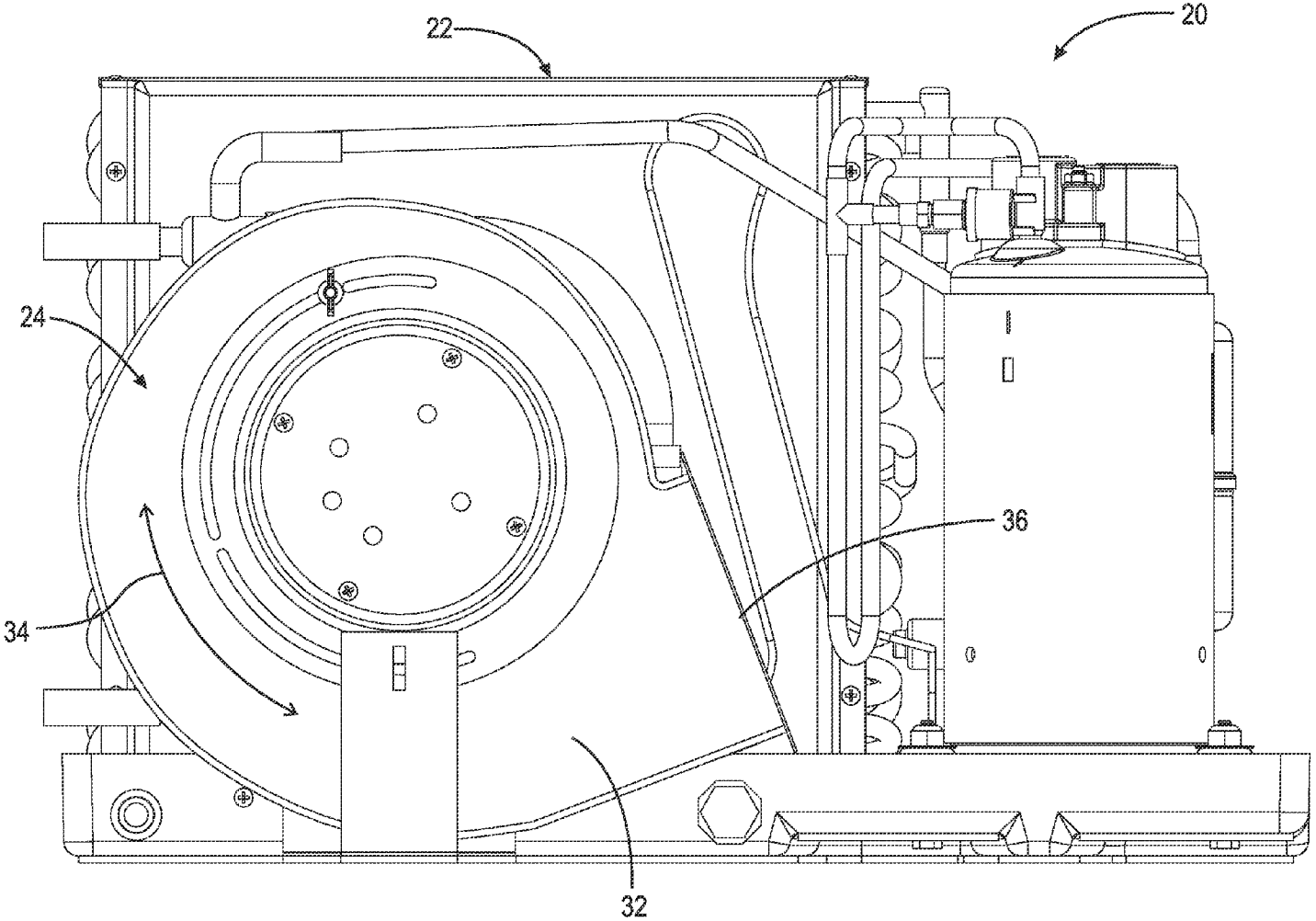
PRIOR ART Fig. 4
FIG. 4 is a side elevational view of the prior art air conditioning system of FIG. 1 with the air guide in a second position.
Figure 5:
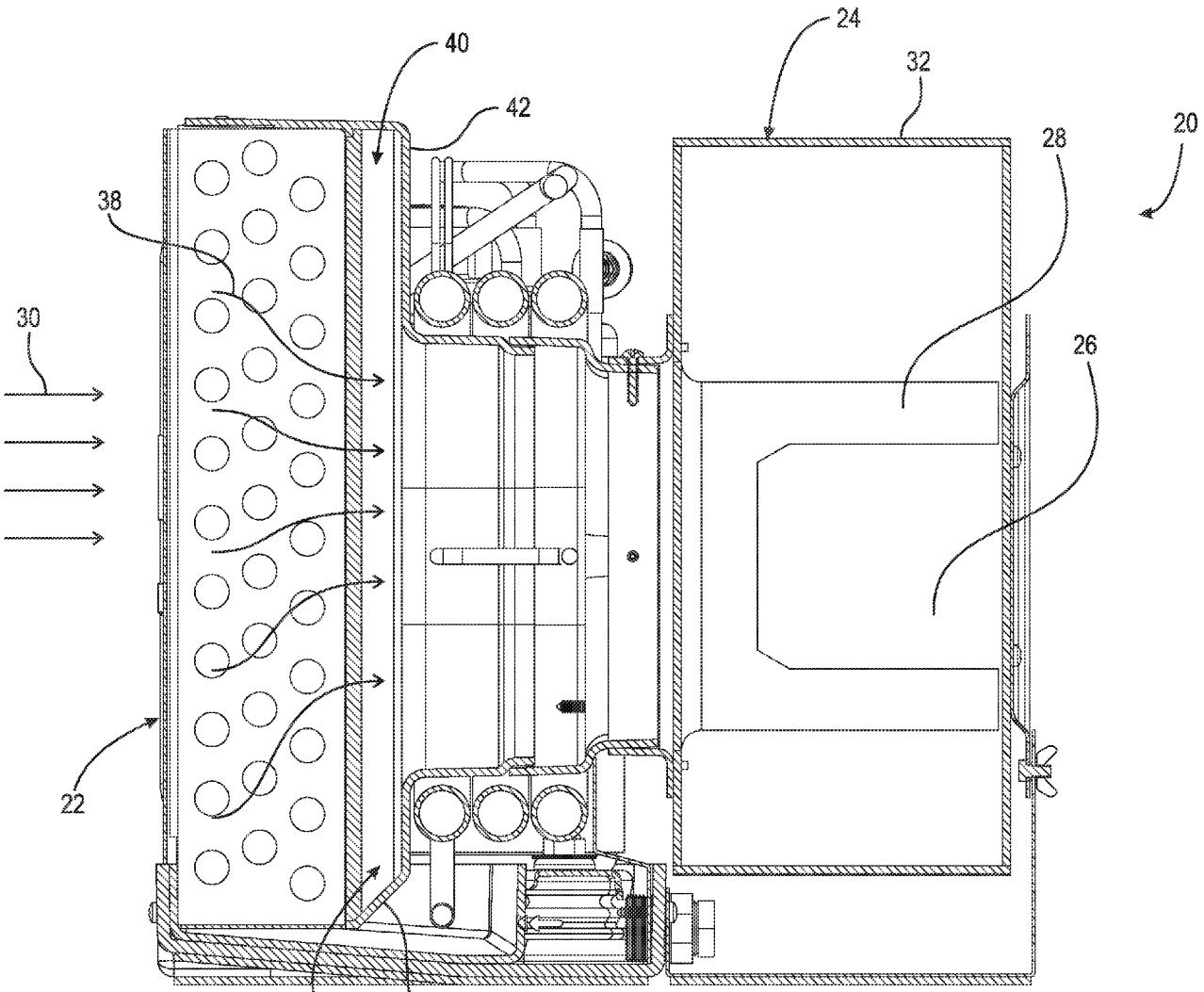
Fig. 5 PRIOR ART
FIG. 5 is a cross sectional view of the prior art air conditioning system of FIG. 1 depicting the path of air flow through the system.
Figure 6:
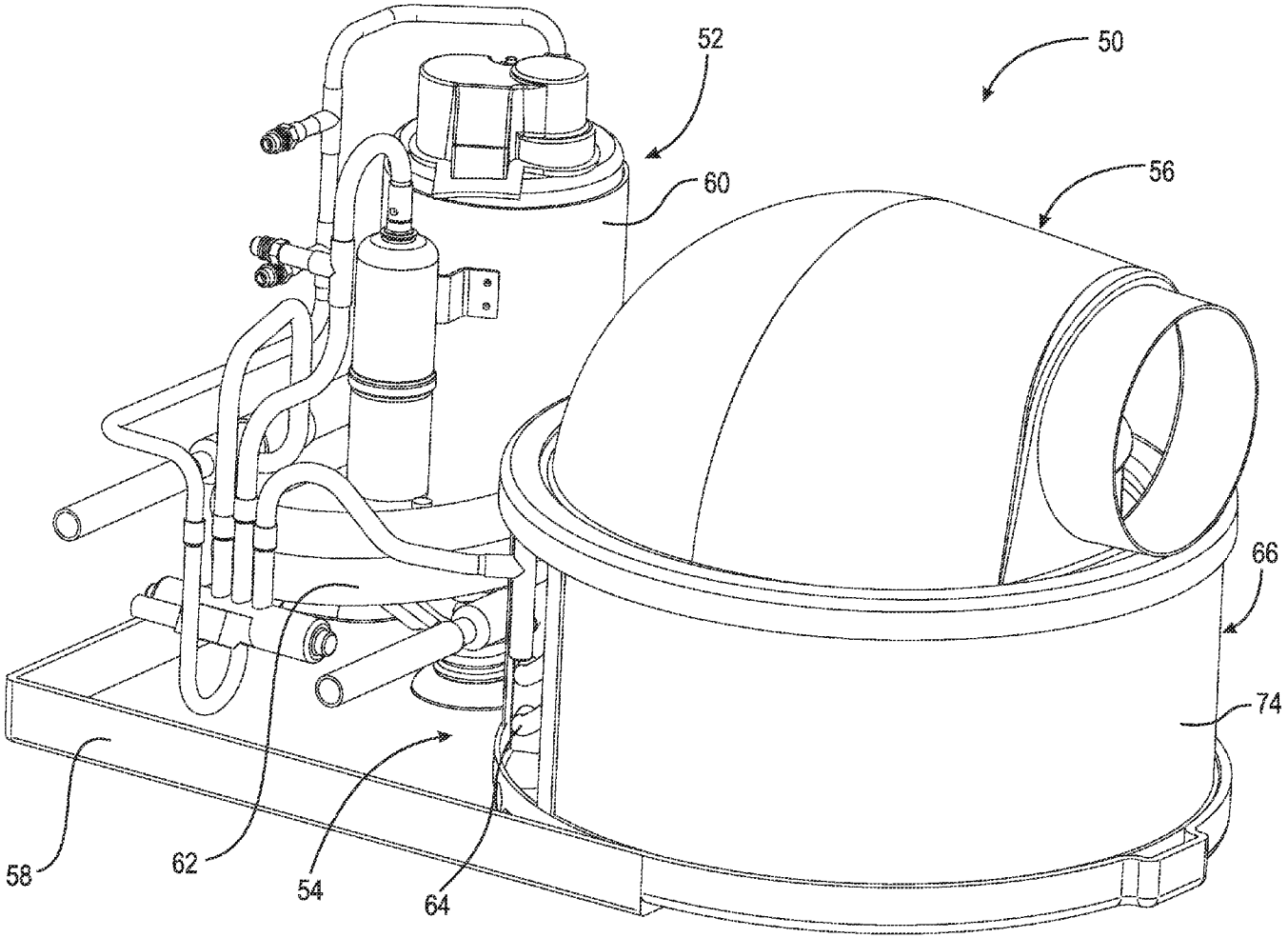
FIG. 6 is a first perspective view of an embodiment of a present air conditioning system.

Adverting now to the figures, FIG. 6 is a first perspective view of an embodiment of present air conditioning (AC) system 50. AC unit 50 comprises compressor assembly 52, evaporator coil assembly 54, exhaust shroud 56 and drain or mounting pan 58. Compressor assembly 52 includes compressor 60. AC unit 50 is used in a marine self-contained air conditioning system.

Figure 7:
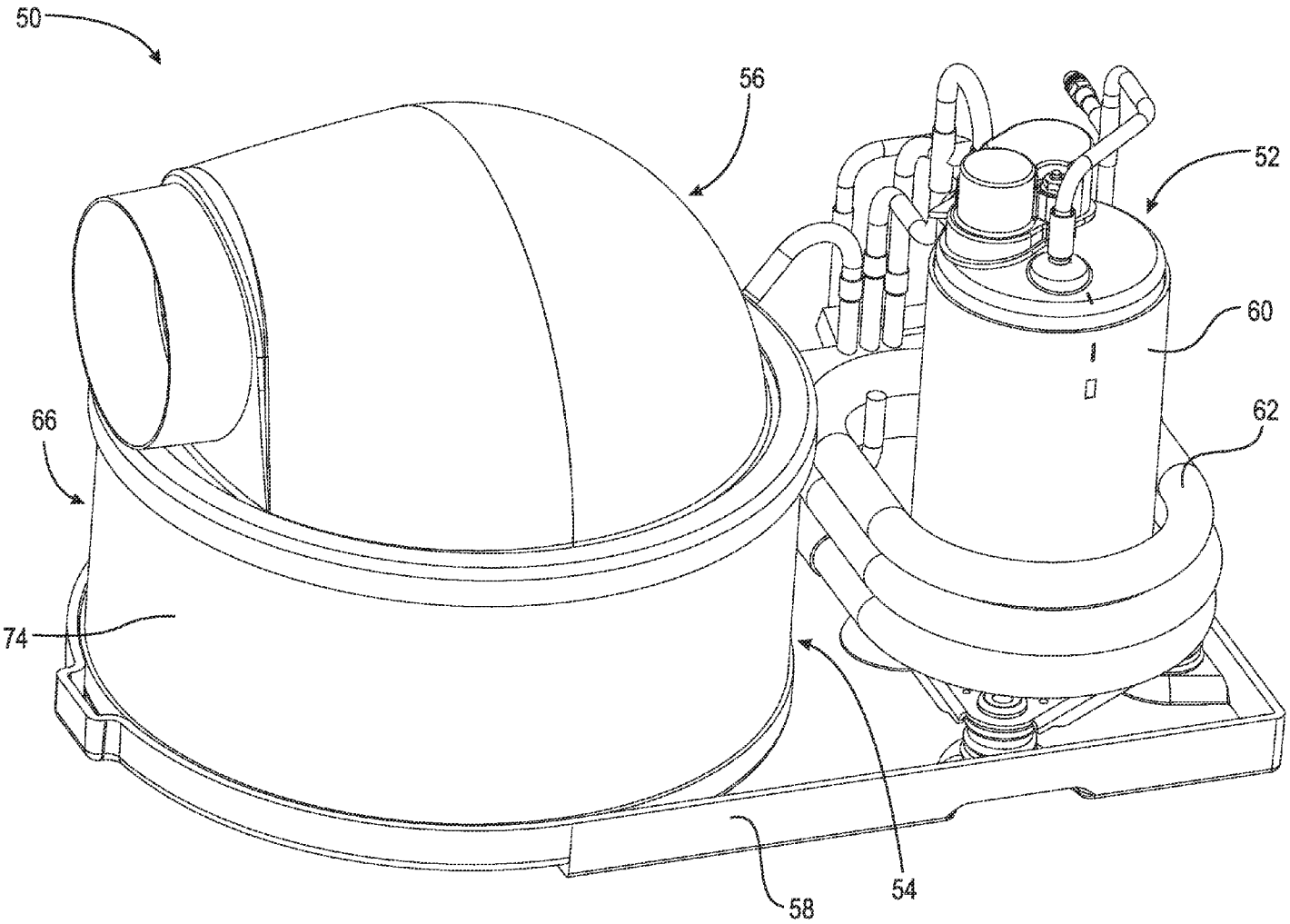
FIG. 7 is a second perspective view of the embodiment of a present air conditioning system of FIG. 6.
Figure 8:
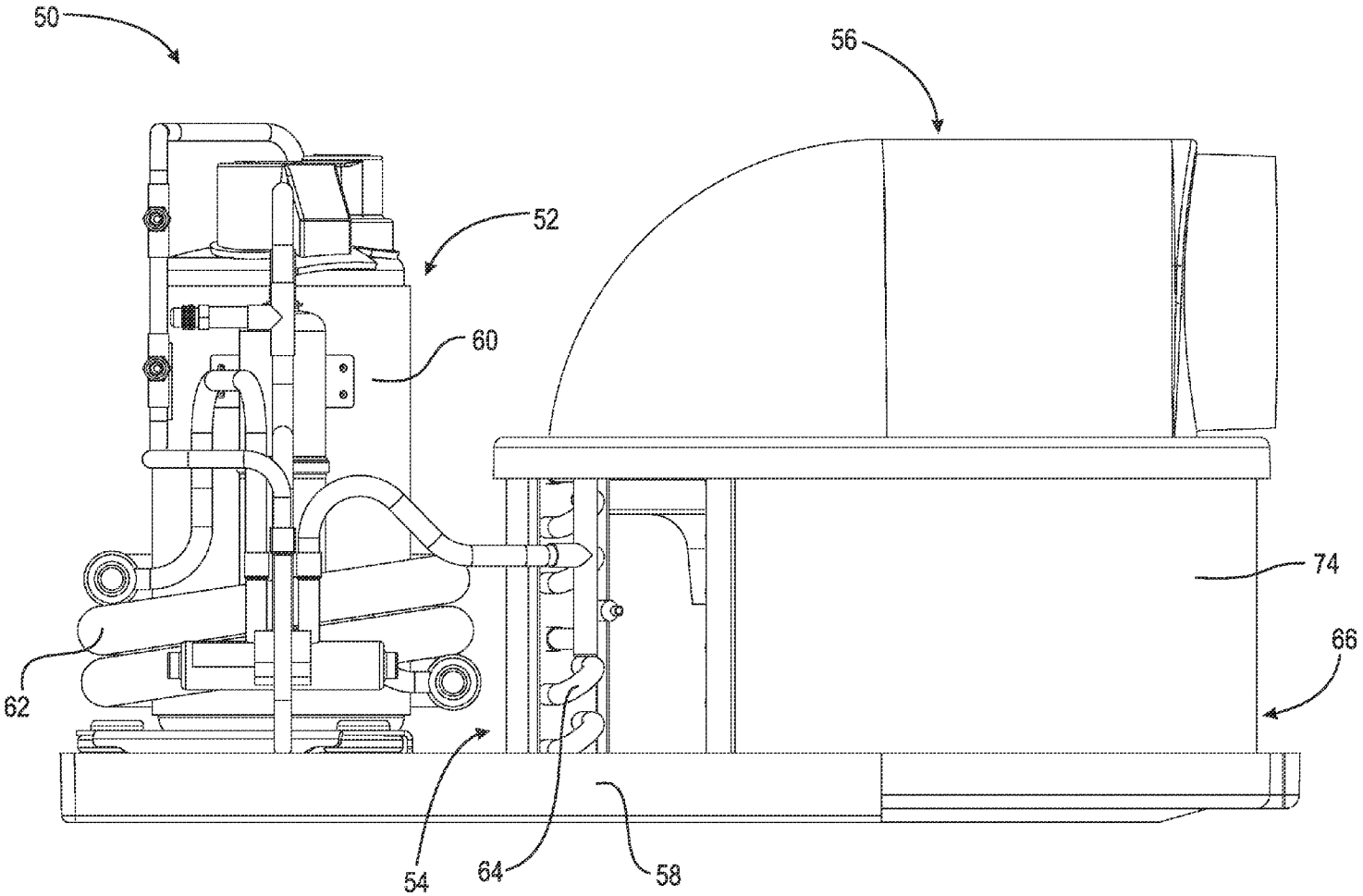
FIG. 8 is a side elevational view of the embodiment of a present air conditioning system of FIG. 6.

FIGS. 7 and 8 are a second perspective view and a side elevational view of an embodiment of present air conditioning system 50.

Figure 9:
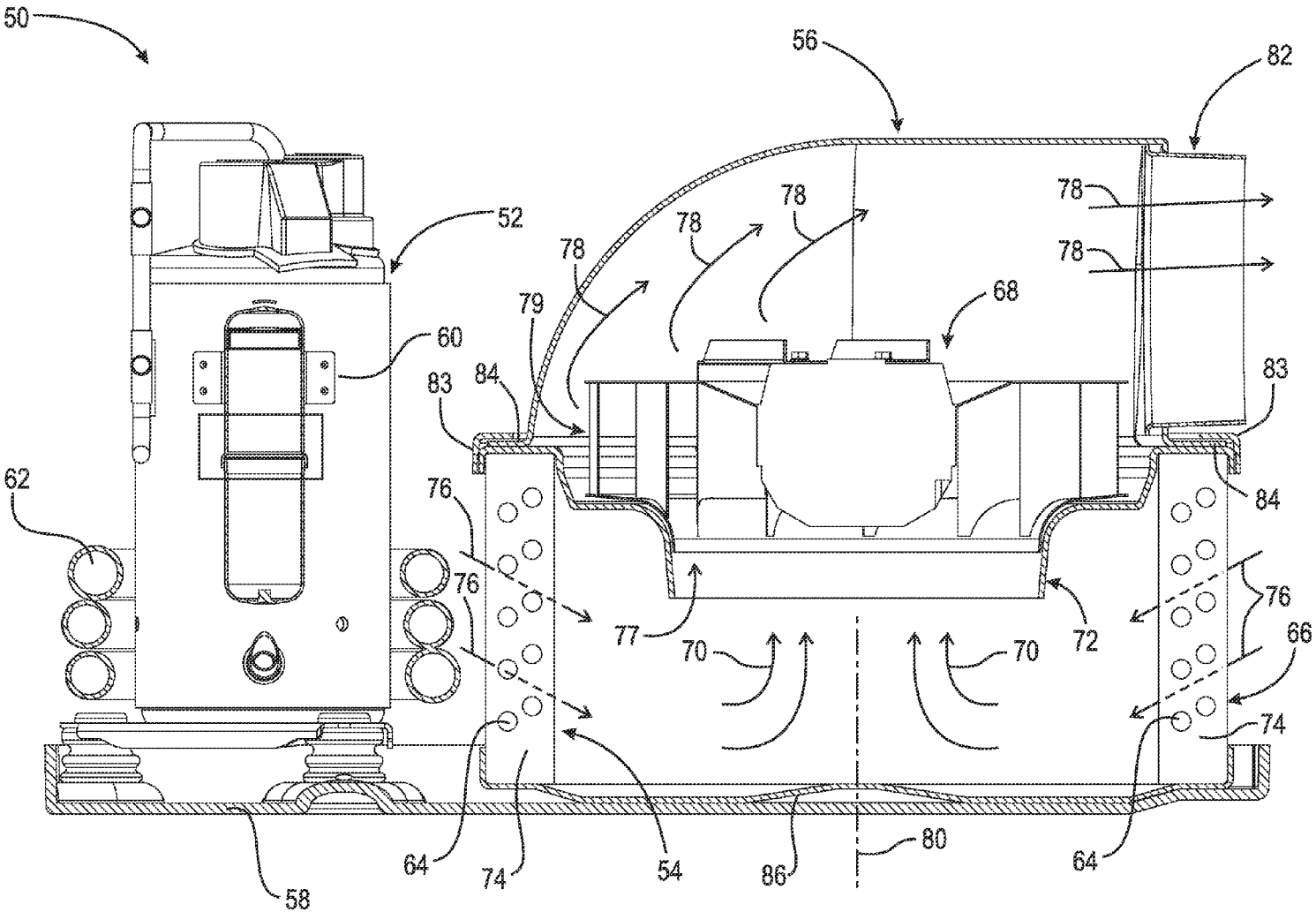
FIG. 9 is a cross sectional view of the embodiment of a present air conditioning system of FIG. 6 depicting the path of air flow through the system.
Figure 10:
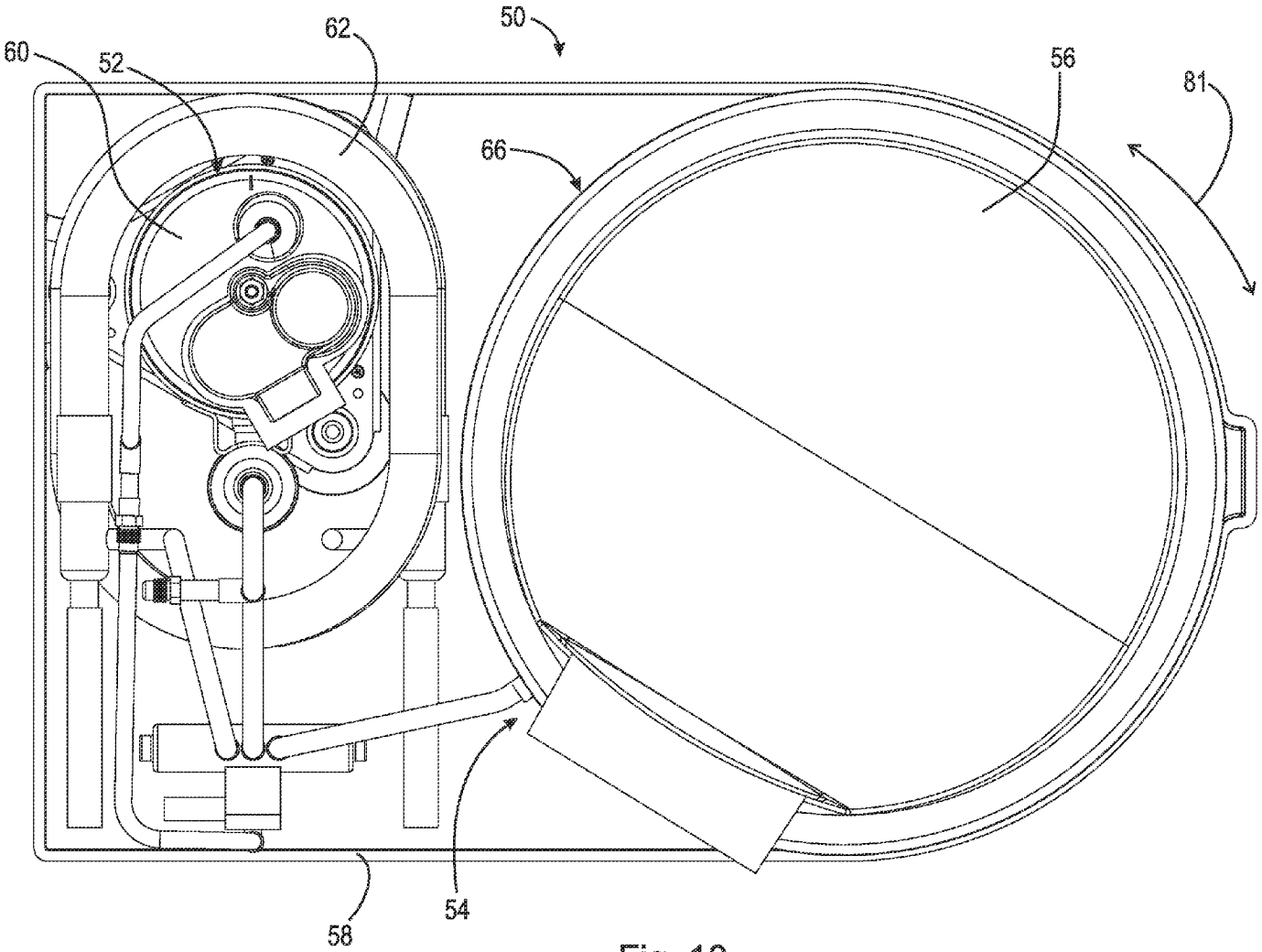
FIG. 10 is a top plan view of the embodiment of a present air conditioning system of FIG. 6 with the air guide in a first position.
Figure 11:
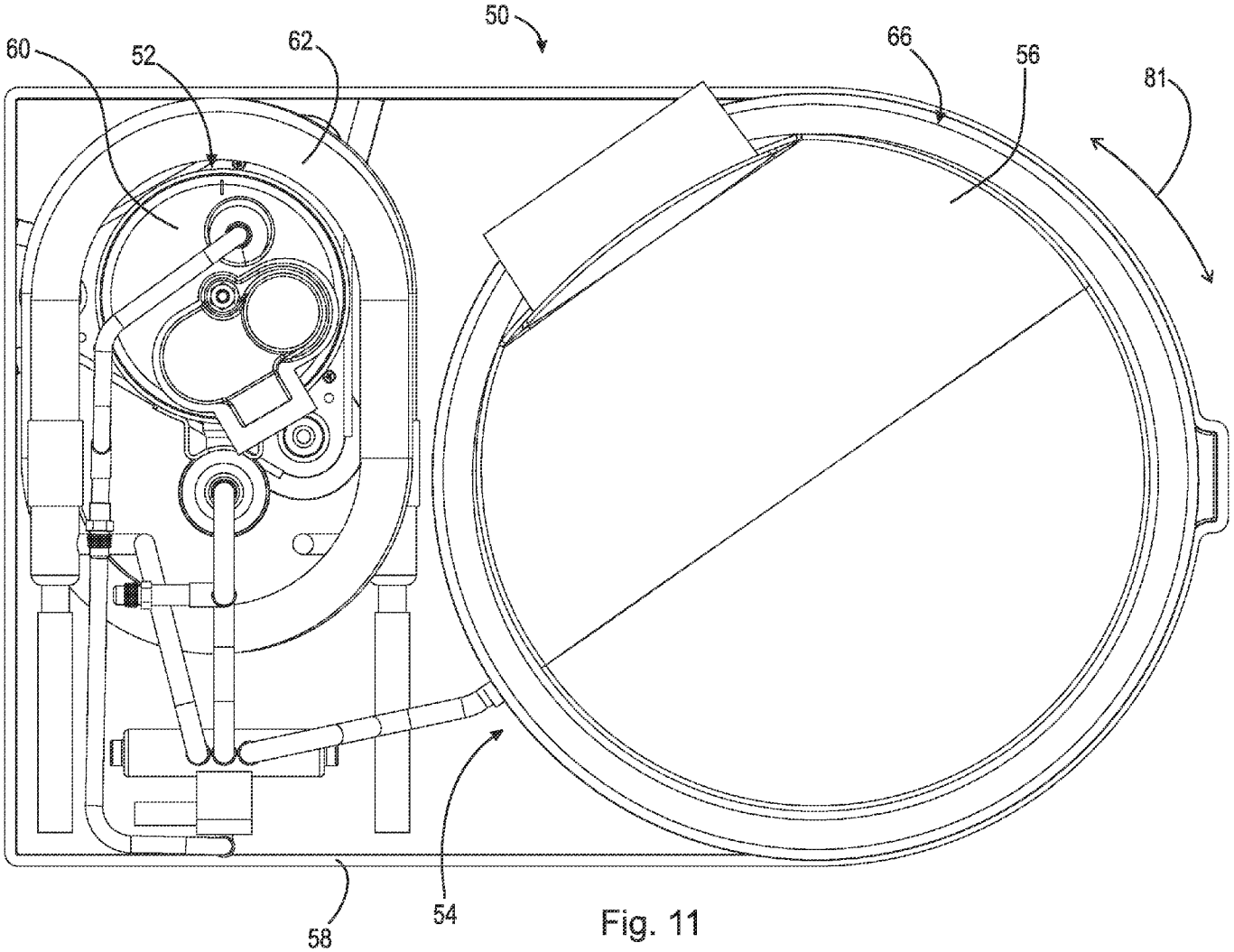
FIG. 11 is a top plan view of the embodiment of a present air conditioning system of FIG. 6 with the air guide in a second position; and, FIG. 12 is a top plan view of the embodiment of a present air conditioning system of FIG. 6 with the air guide in a third position.
Figure 12:
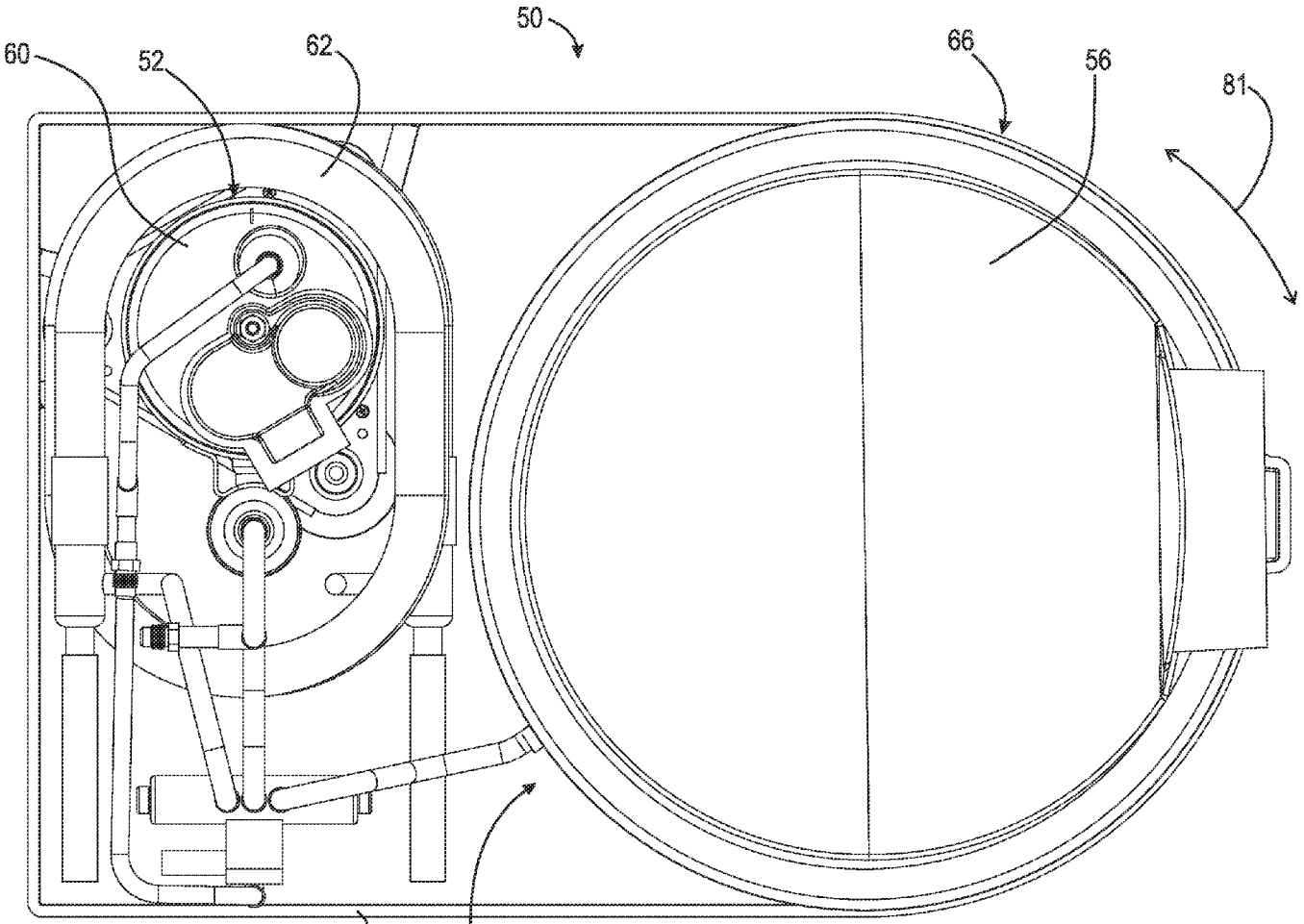

FIG. 9 is a cross sectional view of an embodiment of a present air conditioning system, i.e., AC system 50. Broadly, the basic components of AC unit 50 include compressor assembly 52, evaporator coil assembly 54, exhaust shroud 56 and drain or mounting pan 58. Compressor assembly 52 comprises condenser 62 and compressor 60. Evaporator coil assembly 54 comprises evaporator coil 64, which coils are in thermal communication with evaporator fin assembly 66. Compressor 60 is arranged in fluid communication with evaporator coil 64 and condenser 62, while evaporator coil 64 is arranged in fluid communication with condenser 62. Blower 68 is arranged to exchange a volume of air over evaporator coil 64 and evaporator fin assembly 66, thereby cooling the volume of air. Blower 68 is arranged to move air in a direction coaxial to the central axis of the cylinder created by evaporator coil assembly 54, i.e., as depicted by uni-directional arrows 70. The air is moved from the cylindrical interior of evaporator coil assembly 54 through circular duct 72 and blower assembly 68 to the interior of exhaust shroud 56.

Evaporator coil 64 comprises a continuous cylindrical winding of a tube, through which coolant in liquid or gaseous phase can flow. The tube may be wound in a helical arrangement or in a series of circumferential sub-windings arranged on parallel, axially-orthogonal planes, which sub-windings are connected to adjacent circumferential sub-windings with axially arranged tube sections. Other winding arrangements for evaporator coil 64 are also possible; however, the overall arrangement of evaporator coil 64 and thereby evaporator fin assembly 66 is that of a cylindrical shell. It should be appreciated that other embodiments are also possible, e.g., non-cylindrical windings of evaporator coil 64. In such embodiments, the overall cylindrical shape of evaporator coil assembly 54 can be formed by proper shaping of evaporator fin assembly 66. In short, the foregoing embodiments rely on the combination of evaporator coil 64 and evaporator fin assembly 66 to form the general cylindrical shape of evaporator coil assembly 54.

Evaporator fin assembly 66 comprises an overall cylindrical-shaped arrangement of fins 74 that are in thermal communication with evaporator coil 64. The individual fins, i.e., fins 74, in evaporator fin assembly 66 may comprise aluminum, copper, or other similarly thermally-conductive materials, and they are arranged such that they are radially-disposed relative to the central axis of the cylinder created by the arrangement of fins. The thermal communication of evaporator fin assembly 66 with evaporator coil 64 increases the effective surface area of evaporator coil 64 in order to increase the efficiency of the heat exchange between air passing through evaporator coil assembly 54, i.e., through evaporator fin assembly 66 and evaporator coil 64. In short, by increasing the effective surface area of evaporator coil 64, air entering AC unit 50 through evaporator coil assembly 54 is more efficiently cooled. The thermal communication of evaporator fin assembly 66 with evaporator coil 64 may be affected by soldering evaporator fin assembly 66 with evaporator coil 64, pressure-fitting evaporator fin assembly 66 to evaporator coil 64, attaching evaporator fin assembly 66 to evaporator coil 64 with thermally-conductive glue or resin, or by similar methods known in the art. The overall arrangement of evaporator fin assembly 66 is that of a cylindrical shell which envelops evaporator coil 64.

During operation of AC unit 50, the arrangement of evaporator coil assembly 54 in combination with blower 68 causes air 76 to pass through evaporator coil assembly 54 with substantially constant pressure and velocity over the entire surface of evaporator coil assembly 54. In short, it has been found that the cylindrical geometry of evaporator coil assembly 54 provides an increased efficiency for air flow and thereby heat transfer within AC system 50. Air 76 having been cooled by its passage through evaporator coil assembly 54 is then pulled axially and radially, relative to the central axis of the cylinder created by evaporator coil assembly 54, from the cylindrical interior of evaporator coil assembly 54 into circular duct 72 and subsequently to intake 77 of blower assembly 68. Air leaving blower assembly 68, i.e., air 78, exits through blower exhaust 79 into exhaust shroud 56. Exhaust shroud 56 is adapted to rotate about a vertical axis, i.e., longitudinal axis 80 thereby providing a variety of directions for air 78 to exit from exhaust shroud 56 relative to AC system 50. In an embodiment, the axis of rotation of exhaust shroud 56 is coaxial with the axis of the cylinder formed by evaporator coil assembly 54. The direction of rotation is depicted by bi-directional arrow 81. In some embodiments, exhaust shroud 56 rotates approximately two hundred seventy (270) degrees. It should be appreciated that exhaust shroud 56 may rotate more or less than 270 degrees and such embodiments are within the spirit and scope of the claimed invention. Air 78 then exits through a properly shaped transitional circular opening 82 in exhaust shroud 56 where the air is then moving on a horizontal plane.

Exhaust shroud 56 may be rotatably secured to evaporator coil assembly 54 with a centrally disposed rod; however, in the embodiments depicted in the figures, exhaust shroud 56 is rotatably secured to evaporator coil assembly 54 between duct 72 and ring 83 at flange 84 of shroud 56. In embodiments including a centrally disposed rod, means of securing the rod in rotatable engagement to exhaust shroud 56 and evaporator coil assembly 54 include means commonly known in the art, e.g., nuts and washers or pins secured in through-bores in the rod.

It should be appreciated that further efficiency can be obtained by incorporating a shaped or contoured base at the end of evaporator coil assembly 54 opposite blower 68, e.g., shaped base unit 86. In the embodiment depicted, shaped base unit 86 comprises a generally W shaped cross section; however, other shapes are also possible, e.g., a centrally disposed conical shape, and such embodiments are within the spirit and scope of the claimed invention.

The present invention provides a variety of advantages over known self-contained marine air conditioners and air handling systems in general. In the present invention, all incoming air 76 that crosses fins 74 in evaporator coil assembly 54, sees a uniform pressure drop and crosses fins 74 at substantially the same velocity over the entire assembly 54. This permits the optimization of the size of evaporator coil 64, i.e., the evaporator coil size may be tightly controlled thereby permitting a decreased size for the overall AC system. Moreover, all the material used in the evaporator coil and evaporator fin assembly is engaged in transferring heat energy, and due to the uniform pressure drop across the outer surface of evaporator coil assembly 54, every surface does so uniformly. In short, efficiency losses are minimized. The present invention allows for air already moving inwardly and radially to enter a round orifice further increasing mechanical and thermal efficiency. The present invention allows for a backward inclined blower wheel to be used to its maximum efficiency as it is mounted in line to the incoming air which is allowed to exit the blower wheel into an expanding circular discharge area. The shape of shroud 56 may be further optimized to minimize loss of energy during the transition of cooled air 78 from blower 68 to shroud 56.

By having a rotatable exhaust blower shroud independent of the blower, the energy needed to move the air is reduced and more air is able to pass through the blower because the shape of the dome can be configured and matched to the pressure drop the entire AC assembly generates, thus further increasing efficiency. Exhaust shroud 56 allows for the infinite adjustment of the direction of exhausting air 78 in a complete horizontal plane, allowing cooled air 78 to be directed in any direction under the enclosure of the air conditioner, e.g., a bunk. This invention is more efficient than existing units allowing for a decrease in the cost to manufacture and a reduction in the overall size to produce a given amount of cooling, as well as requiring less energy to produce the same amount of cooling.

The present invention is not limited to use in the marine industry, e.g., tractor trailer cabin AC units.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What we claim is:

1. An air conditioning unit comprising:

a condenser;

a compressor;

an evaporator system comprising an evaporator coil and a plurality of evaporator fins in contact with the evaporator coil, wherein the evaporator system forms a generally hollow cylindrical shape;

a blower comprising an intake side and an exhaust side, the blower adapted to draw a volume of air through the plurality of evaporator fins and expel the volume of air in a direction generally perpendicular with a longitudinal axis of the evaporator system; and, an exhaust shroud arranged adjacent the exhaust side of the blower, wherein the exhaust shroud is adapted for rotational movement about the longitudinal axis of the evaporator system, the compressor is arranged in fluid communication with the evaporator system and the condenser, and the evaporator is arranged in fluid communication with the condenser.

2. The air conditioning unit of claim 1 wherein the evaporator coil forms the generally hollow cylindrical shape.

3. The air conditioning unit of claim 1 wherein the plurality of evaporator fins forms the generally hollow cylindrical shape.

4. The air conditioning unit of claim 1 further comprising a duct, wherein the evaporator system comprises a first end and a second end opposite the first end, the duct is arranged at the second end between the evaporator system and the blower, and the blower draws the volume of air through the plurality of evaporator fins, through the duct and expels the volume of air into the exhaust shroud.

5. The air conditioning unit of claim 4 further comprising a shaped base unit arranged at the first end opposite the blower, and the shaped base unit directs the volume of air towards the duct.

6. The air conditioning unit of claim 4 further comprising a retaining ring and the exhaust shroud comprises a circumferential flange, wherein the duct is arranged adjacent the second end, the circumferential flange is arranged adjacent the duct and the retaining ring is arranged adjacent the circumferential flange, whereby the exhaust shroud is rotatable about the longitudinal axis.

7. The air conditioning unit of claim 1 further comprising a shaped base unit, wherein the evaporator system comprises a first end and a second end opposite the first end, the shaped base unit is arranged at the first end opposite the blower, and the shaped base unit directs the volume of air towards the blower.

8. The air conditioning unit of claim 1 further comprising a retaining ring and the exhaust shroud comprises a circumferential flange, wherein the evaporator system comprises a first end and a second end opposite the first end, the circumferential flange is arranged adjacent the second end and the retaining ring is arranged adjacent the circumferential flange, whereby the exhaust shroud is rotatable about the longitudinal axis.

9. The air conditioning unit of claim 1 wherein the exhaust shroud is adapted to rotate approximately two hundred seventy degrees about the longitudinal axis.

10. An air conditioning unit comprising:

a condenser;

a compressor;

an evaporator system comprising an evaporator coil and a plurality of evaporator fins in contact with the evaporator coil, wherein the evaporator system forms a generally hollow cylindrical shape;

a blower comprising an intake side and an exhaust side, the blower adapted to draw a volume of air through the plurality of evaporator fins and expel the volume of air in a direction generally perpendicular with a longitudinal axis of the evaporator system;

an exhaust shroud arranged adjacent the exhaust side of the blower, wherein the exhaust shroud is adapted for rotational movement about the longitudinal axis of the evaporator system, the compressor is arranged in fluid communication with the evaporator system and the condenser, and the evaporator is arranged in fluid communication with the condenser; and, a mounting pan, wherein the compressor and the evaporator system are secured to the mounting pan.

11. An air conditioning unit comprising:

an evaporator system comprising an evaporator coil and a plurality of evaporator fins in contact with the evaporator coil, wherein the evaporator system forms a generally hollow cylindrical shape;

a blower comprising an intake side and an exhaust side, the blower adapted to draw a volume of air through the plurality of evaporator fins and expel the volume of air in a direction generally perpendicular with a longitudinal axis of the evaporator system; and, an exhaust shroud arranged adjacent the exhaust side of the blower, wherein the exhaust shroud is adapted for rotational movement about the longitudinal axis of the evaporator system.

* * * * *